United States Patent [19]

White

[11] 3,962,967

[45] June 15, 1976

[54] HORIZONTAL TRASH COMPACTOR

[76] Inventor: Lewis P. White, 3436 Brookwood Road, Birmingham, Ala. 35223

[22] Filed: June 26, 1975

[21] Appl. No.: 590,513

Related U.S. Application Data

[63] Continuation-in-part of Ser. No. 246,640, April 24, 1972, Pat. No. 3,893,385, which is a continuation-in-part of Ser. No. 55,706, July 17, 1970, Pat. No. 3,657,999.

[52] U.S. Cl. ..... 100/191; 425/376

[51] Int. Cl.[2] ..... B30B 1/08; B30B 15/32

[58] Field of Search ..... 100/179, 191, 192, DIG. 5, 100/DIG. 8; 425/376 R, 461, 466; 141/391, 392

[56] References Cited

UNITED STATES PATENTS

| | | | |
|---|---|---|---|
| 751,752 | 2/1904 | Pilliod | 100/191 |
| 2,484,506 | 10/1949 | Hawk | 425/376 R |
| 3,213,783 | 10/1965 | May | 100/192 |
| 3,520,411 | 7/1970 | Busse et al. | 100/192 |

*Primary Examiner*—Billy J. Wilhite
*Attorney, Agent, or Firm*—Shlesinger, Arkwright, Garvey & Dinsmore

[57] ABSTRACT

This invention is a trash compactor for compressing trash as it is moved in a horizontal direction. The compactor includes an elongated chamber comprising a rectilinear section into which the trash is placed, a power member for forcing the trash through the rectilinear section, where the trash is initially compacted and, a curvilinear section through which the trash is pushed by the movement of trash through the rectilinear section. The curvilinear section is of sinuous or S-shape configuration and is preferably disposed in a vertical plane. Frictional engagement of the trash with the wails of the curvilinear section effects substantial compaction of the trash prior to emission for disposal. The curvilinear section includes at least two curved parts which are pivotally connected together and pivotally engaged with the rectilinear portion for varying the angularity of the curvilinear section to control the compression of the trash forced therethrough.

14 Claims, 7 Drawing Figures

Fig. 4
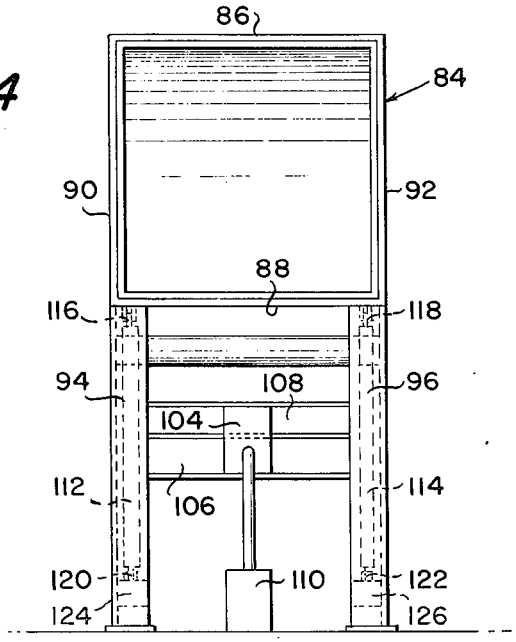
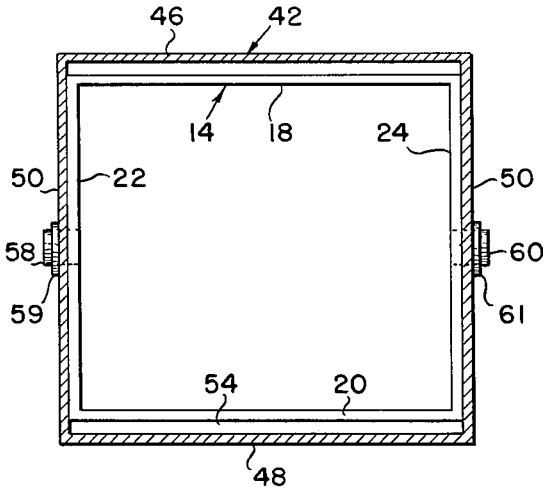
Fig. 5
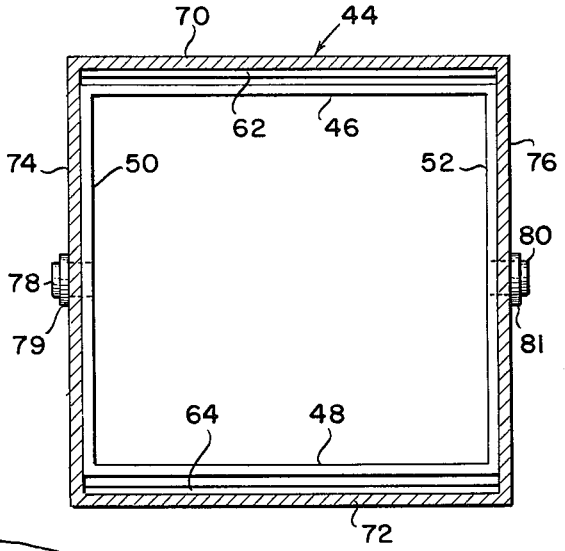
Fig. 6
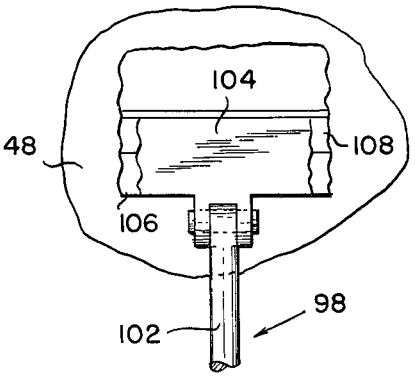
Fig. 7

HORIZONTAL TRASH COMPACTOR

This application is a continuation-in-part of Application Ser. No. 246,640, filed Apr. 24, 1972, now U.S. Pat. No. 3,893,385, which application is a continuation-in-part of Application Ser. No. 55,706, filed July 17, 1970 and issued as U.S. Pat. No. 3,657,999.

BACKGROUND AND OBJECTS

In my copending application, Ser. No. 246,640, now U.S. Pat. No. 3,893,385, there is disclosed a horizontally disposed trash compactor including an elongated stationary chamber embodying a rectilinear section and a curvilinear section. Power means operable through the rectilinear section force trash through the chamber and frictional engagement of the trash with the walls of the chamber effect initial compression of the trash. Continual operation of the power member forces trash into the curvilinear section where, due to the curvature of the chamber, increased frictional resistance to the passage of the trash takes place with a corresponding increase in the compression of the trash.

In the compaction of trash with the apparatus of my copending application, a wide variance in the degree of trash compression can occur because of the wide range of frictional characteristics of the trash itself. For example, corrugated cardboard frictionally engages side walls of the curvilinear section with such force that it is sometimes difficult to force this material completely through the apparatus without jamming. On the other hand, greasy or oily materials produce very little friction with the chamber walls and are easily forced through the curvilinear section. In my previous application, adjustable gate means have been provided in the curvilinear section to reduce the size of the passage through which the trash passes, thereby increasing compaction of the trash.

It is an object of this invention to provide a trash compactor embodying a horizontally disposed elongated chamber including a rectilinear section and a curvilinear section, the curvilinear section being variable to increase or decrease the frictional resistance of the trash passing therethrough, to control the compression of the trash.

Another object is to provide a trash compactor of the character described wherein the curvilinear section comprises a pair of reversely curved portions pivotally engaged with each other and pivotally engaged with the rectilinear section, for varying the angularity of the curvilinear section.

A further object is to provide a trash compactor of the character described which further includes a delivery tube into which the compressed trash is delivered from the curvilinear section, the delivery tube being stationary in order to facilitate deposit of the compacted trash on trucks, rail cars, etc.

A further object is to provide a trash compactor of the character described wherein power means is engageable with the curvilinear section for changing the angularity of the latter to control the compression of the trash.

A still further object is to provide a trash compactor of the character described wherein compression of trash therein is effected without the use of gates or other extraneous means for controlling the flow of trash through the chamber passage.

Other objects will be apparent from the following description of the presently preferred forms of the invention taken in connection with the appended drawings wherein:

FIG. 4 is an end elevational view of the present invention taken from the outlet end thereof;

FIG. 5 is a sectional view taken along the line 5—5 of FIG. 3, looking in the direction of the arrows;

FIG. 6 is a sectional view taken along the line 6—6 of FIG. 3, looking in the direction of the arrows; and FIG. 7 is a sectional view taken along the line 7—7 of FIG. 3, looking in the direction of the arrows.

SUMMARY OF THE INVENTION

Figure 1:
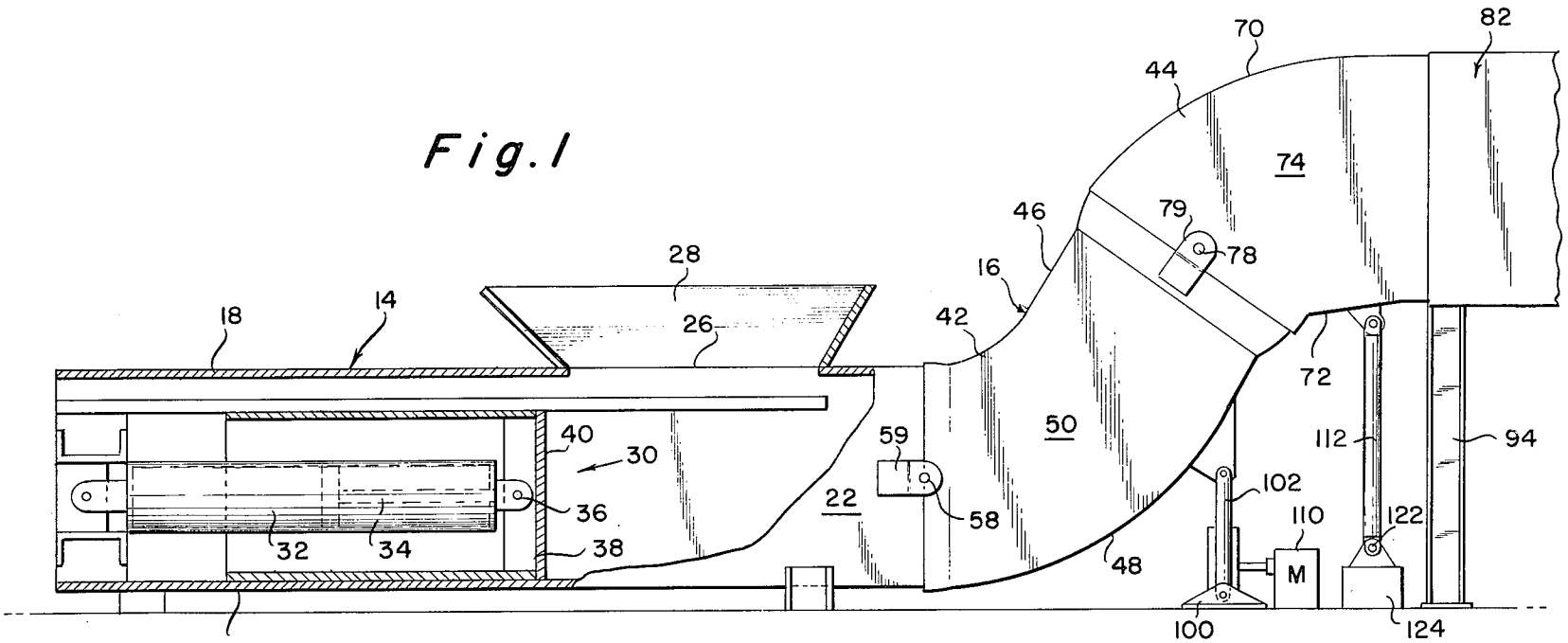
FIG. 1 is a side elevational view of a trash compactor constructed in accordance with the present invention, portions thereof being broken away to disclose details.
Figure 2:
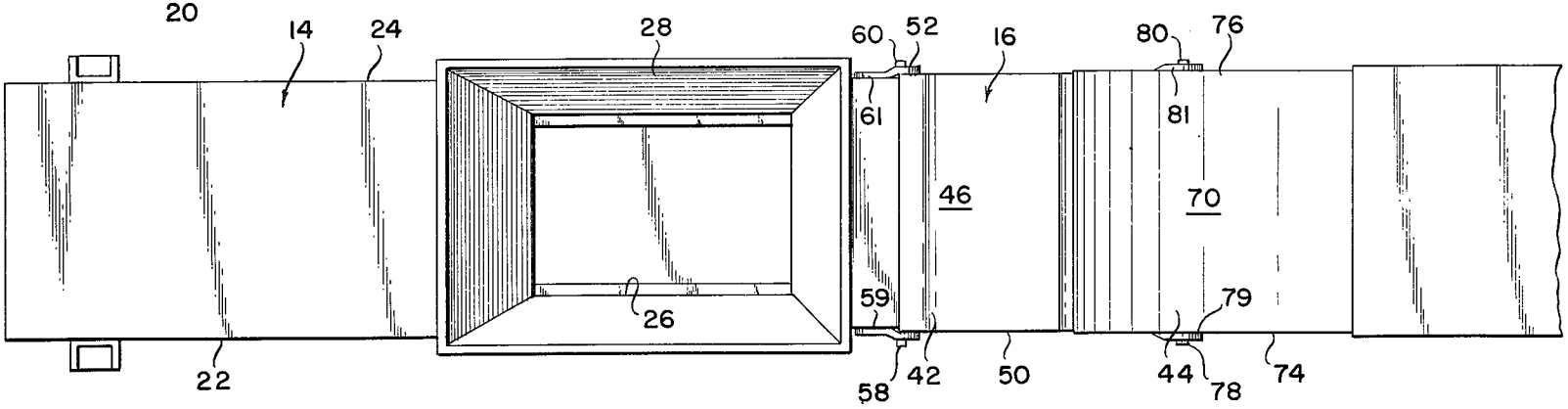
FIG. 2 is a top plan view of the same.

The present invention is a trash compactor including an elongated chamber comprising a rectilinear section which is disposed in a horizontal plane and a curvilinear section in communication with the rectilinear section. Trash is fed into the rectilinear section and pushed into the curvilinear section by a power member. As the trash builds up in the rectilinear section, the repeated operation of the power member effects initial compression of the trash as it frictionally engages the walls of the section.

The curvilinear section is of generally S-shape conformation and includes a pair of reversely curved portions which are pivotally connected with each other, the one portion being pivotally engaged also with a terminal of the rectilinear section. The outermost portion of the curvilinear section is engaged with a stationary delivery tube and is movable with respect thereto.

Power means are engageable with one portion of the curvilinear section for effecting relative movement of the two portions with respect to each other and with respect to the rectilinear section and the delivery tube, for changing the curve of the curvilinear section to correspondingly alter the frictional engagement with the trash being passed through the curvilinear section, thereby controlling the compression thereof.

DESCRIPTION OF THE FORM OF INVENTION ILLUSTRATED IN FIGS. 1 TO 5

In FIGS. 1 to 5, there is illustrated a trash compactor constructed in accordance with the present invention which includes an elongated chamber open at both ends and comprising a rectilinear section 14, one terminal of which is engaged with a curvilinear section 16.

Rectilinear section 14 is substantially the same construction as set out in application Ser. No. 246,640, and includes a top 18, a bottom 20 and side walls 22 and 24. A portion of top 18 is cut away to provide a trash opening 26 and a hopper 28 is mounted on the top proximate the opening to facilitate the delivery of trash to the interior of the rectilinear section.

A packer assembly 30 is mounted within rectilinear section 14 and includes a horizontally disposed cylinder 32 having a piston 34, the outer end of which is connected at 36 to a packer member 38. Packer member 38 is preferably square in cross-section and provided with a front pressure plate 40 adapted for engagement with the trash.

Curvilinear section 16 includes two reversely curved portions designated 42 and 44 which, when joined together, are of substantially S-shape configuration.

Curved portion 42 includes a top 46, bottom 48 and side walls 50 and 52. Curved portion 42 is engaged with a terminal of rectilinear section 22 and, to effect this purpose, a peripheral ring 54 is engaged with the outer periphery of the rectilinear section of the ring being beveled at 56 from the forward to the aft end thereof for purposes which will be hereinafter more fully set out.

Portion 42 is pivotally engaged with rectilinear section 20 by means of pivot pins or pipes 58 and 60 which are welded or secured in any other suitable manner to the side walls of rectilinear section 20. Pins extend through the side walls 50 and 52 of portion 42 in order to permit limited vertical movement of portion 42 with respect to rectilinear section 20 as illustrated by the full and dotted lines in FIG. 3. Straps 59 and 61 are engaged with pins 58 and 60 respectively and are secured to side walls 22 and 24 of section 14 to distribute forces exerted on the pins.

The opposite terminal of portion 42 is provided with arcuate plates 62 and 64 which are preferably of steel construction, the plates being secured to top 46 and bottom 48 respectively, at points spaced from the near terminal of portion 42, as indicated at 66 and 68.

Figure 3:
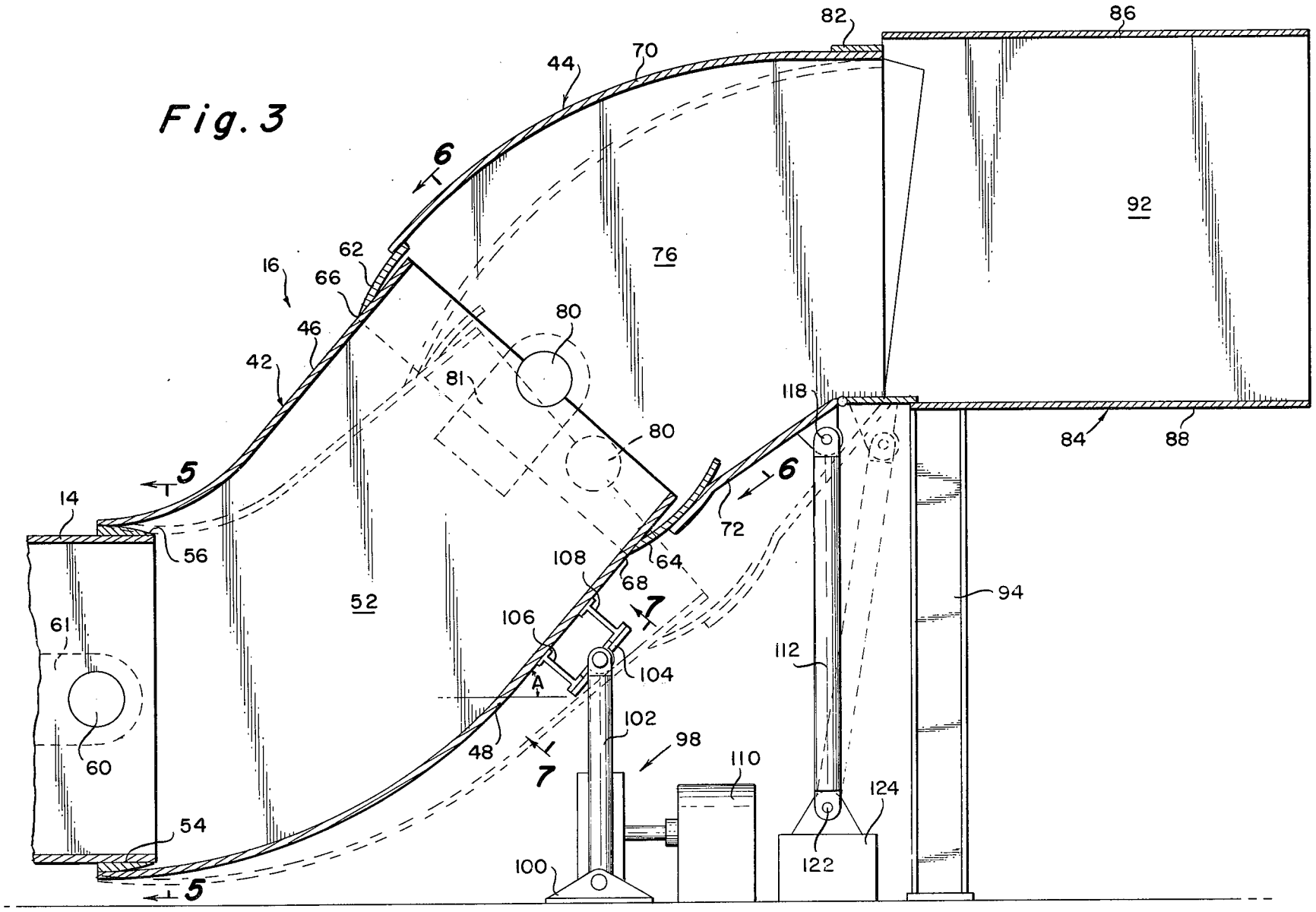
FIG. 3 is an enlarged side elevational view of the curvilinear section of the present horizontal compactor, showing in dotted lines alternate positions of adjustment thereof.

Curved portion 44 includes a top 70, a bottom 72 and side walls 74 and 76. Curved portion 44 is sleeved over a terminal of curved portion 42 and is pivotally connected therewith by means of pivot pins or pipes 78 and 80 which are welded or secured in any other suitable manner to side walls 50 and 52 of curved portion 42 respectively and extend through side walls 74 and 76 of curved portion 44. As indicated in FIG. 3, this permits relative vertical movement between curved portions 42 and 44. Straps 79 and 81 are engaged with pins 78 and 80. and secured to walls 50 and 52 of portion 42 for distributing the forces exerted on the pins.

It will also be noted from FIG. 3 that arcuate plates 62 and 64 engage complemental arcuate portions of top 70 and bottom 72, so that these two portions are in sliding engagement upon adjustment of the curved portions.

In accordance with the present invention, the upper end portion of curved portion 44 extends through a stationary rectangular sleeve 82 which is supported by a delivery tube generally designated 84 having a top 86, a bottom 88 and side walls 90 and 92. Delivery tube 84 is stationary and is supported by suitable ground supported columns 94 and 96 which are engaged with the delivery tube at a point adjacent curved portion 44. This permits the delivery tube to cantilever into the truck or other conveyance into which the trash is delivered.

In accordance with the objects of the present invention, the angularity or slope of curvilinear section 22 is adjusted by vertical movement of portions 42 and 44 with respect to each other and with respect to rectilinear section 20 and delivery tube 84. For this purpose, there is provided a motorized screw assembly 98 of conventional construction including a base member 100 having a shaft threadedly engaged therewith. The upper terminal of the shaft is journaled in a stationary plate member 104 secured to beam members 106 and 108 which are fixed to the outer periphery of bottom

48 of curved portion 42. Any suitable motor means 110 is operatively engaged with the shaft to effect vertical movement thereof and corresponding vertical movement of portion 42.

In connection with motorized screw assembly 98, there is provided a pair of pivoting columns 112 and 114, the upper ends of which are pivotally secured at 116 and 118 to bottom 72 of curved portion 44. The lower terminals of columns 112 and 114 are pivoted at 120 and 122 to ground supported members 124 and 126 as illustrated in FIG. 3, vertical movement of shaft 102 effects a corresponding movement of columns 112 and 114 to alter the relative positions of curved portions 42 and 44 and to increase or decrease the angularity of curvilinear section 22.

It has been found that optimum results are obtained with the apparatus of the present invention when angle A illustrated in FIG. 3, which is the angle between the straight portion of bottom wall 48 and a line drawn horizontal thereto ranges from 42° to 54°. The lower angular limit effects less compression than the upper angle limit when trash having the same frictional characteristics is passed through the curvilinear section. Therefore, the desired compression of the trash is readily effected by adjustment of the angularity of curvilinear section 16.

Curvilinear section 16 is preferably disposed in a vertical plane in order to permit the force of gravity to further aid in compression of the trash within the curvilinear section. The vertical disposition of the curvilinear section additionally permits the trash to be delivered at a height from the ground to facilitate placement of the trash on a truck or other conveyance. It will further be noted that delivery tube 84 remains in a stationary position and is cantilevered in order to further facilitate delivery of trash onto a truck at the same height.

OPERATION

In use of the apparatus of the present invention, trash is deposited into hopper 28 for delivery thereof to rectilinear section 14 of the compactor. Actuation of packer assembly 30 effects reciprocating motion of packer member 38 to gradually force the trash through the rectilinear section toward the curvilinear section. During this time, initial compression of the trash is effected.

The trash is then forced upwardly through the reversely curved portions 42 and 44 of curvilinear section 16 by the trash in the rectilinear section where the compression thereof is principally effected by frictional engagement with the walls of the curved portions.

The amount of compression produced is controlled by the angular setting of curved portions 42 and 44. As illustrated in FIG. 3, the relative positions of curved portions 42 and 44 with respect to each other and to rectilinear section 14 is controlled by motorized screw assembly 98, FIG. 3 illustrating the limits of the adjustment of the two curved portions in order to produce a greater or lesser compression effect.

The compressed trash is fed from curved portion 44 through stationary delivery tube 84 to a truck or other conveyance on which the trash is to be placed.

While there has been herein disclosed the preferred embodiment of the present invention, it is to be understood that such has been done for purposes of illustration only, and that various changes may be made therein within the scope of the appended claims.

What I claim is:

1. A trash compactor comprising:

a. an elongated chamber, said elongated chamber including a rectilinear section and a curvilinear section, b. means for admitting trash to said rectilinear section, c. power means for moving trash longitudinally through said rectilinear section into said curvilinear section, d. the trash frictionally engaging the walls of the curvilinear portion to compress the same, and e. means for selectively changing the angularity of the curvilinear section to vary the friction between the trash and walls, for controlling the compression of the trash.

2. The trash compactor of claim 1, wherein:

a. the curvilinear section is of substantially S-shape conformation.

3. The trash compactor of claim 2, wherein:

a. said curvilinear section comprises a pair of reversely curved portions pivotally connected to each other, and b. said curvilinear section being pivotally engaged with said rectilinear section.

4. The trash compactor of claim 3, with the addition of:

a. means engageable with one of said curved portions for altering the angularity thereof with respect to said rectilinear section, b. the alteration of said one of said curved portions producing a corresponding alteration of the other of said curved portions pivotally connected thereto.

5. The trash compactor of claim 3, with the addition of:

a. a stationary delivery tube positioned at the outlet end of said curvilinear portion for receiving one of said curved portions.

6. The trash compactor of claim 2, wherein:

a. said curvilinear section lies in a vertical plane.

7. A trash compactor comprising:

a. an elongated chamber, b. said elongated chamber including rectilinear and curvilinear sections, c. means for admitting trash to said rectilinear section, d. power means for moving trash longitudinally through said rectilinear section into said curvilinear section, e. said curvilinear section being of substantially S-shape conformation and including reversely curved portions, f. means for pivotally connecting said curved portions together, g. means for pivotally connecting one of said curved portions to said rectilinear section, h. means engageable with one of said curved portions for altering the angularity thereof with respect to said rectilinear section, i. the alteration of said one of said curved portions producing a corresponding alteration of the other of said curved portions pivotally connected thereto, and j. a stationary delivery tube adapted to receive a terminal of one of said curved portions.

8. The trash compactor of claim 7, wherein:

a. said curvilinear section lies in a vertical plane.

9. The trash compactor of claim 8, with the addition of:

a. support means for maintaining the upper limit of said curvilinear section at a constant height.

10. The trash compactor of claim 9, wherein:

a. said support means comprises ground supported members, and b. columns extending between and pivotally engaged with, said ground supported members and one of said curved portions.

11. The trash compactor of claim 7, wherein:

a. said means for pivotally connecting said curved portions together comprise pins secured to the outer periphery of the sides of one of said curved portions, b. said pins extending through the side walls of the other of said curved portions.

12. The trash compactor of claim 11, with the addition of:

a. strap means, one end of each of which is engaged with one of said pins, b. the opposite end of said strap means being secured to the side wall of the other of said curved portions.

13. The trash compactor of claim 7 wherein:

a. said means for pivotally connecting one of said curved portions to said rectilinear section comprises pins secured to the outer periphery of the sides of said rectilinear section, and b. said pins extending through the side walls of the other of said curved portions.

14. The trash compactor of claim 13, with the addition of:

a. strap means, one end of each of which is engaged with one of said pins, b. the opposite end of said strap means being secured to the side wall of the other of said curved portions.

* * * * *